United States Patent [19]

Kim

[11] Patent Number: 4,877,139

[45] Date of Patent: Oct. 31, 1989

[54] CONTAINER WITH AN OPENING DEVICE COMPRISING A GUIDE STRIP AND TEAR BAND

[76] Inventor: Myun H. Kim, 37-57 80th St. 190 D37, Jackson Heights, N.Y. 11372

[21] Appl. No.: 188,224

[22] Filed: Apr. 29, 1988

Related U.S. Application Data

[63] Continuation-in-part of Ser. No. 947,806, Dec. 30, 1986.

[51] Int. Cl.[4] ..... B65D 27/38

[52] U.S. Cl. ..... 206/617; 206/605; 206/610; 206/618; 206/632

[58] Field of Search ..... 206/605, 610, 616–618, 206/632

[56] References Cited

U.S. PATENT DOCUMENTS

| | | | |
|---|---|---|---|
| 1,589,603 | 6/1976 | Lee | 206/616 X |
| 1,640,685 | 8/1927 | Aitelli | 206/605 |
| 2,321,066 | 6/1943 | Dense et al. | 206/617 |
| 2,396,543 | 3/1946 | Velazquer | 206/605 |
| 2,418,526 | 4/1947 | Reitwan | 206/618 X |
| 2,517,801 | 8/1950 | Roush | 206/616 |
| 2,699,286 | 1/1955 | Geffroy | 206/618 X |
| 2,778,562 | 1/1957 | Tilly | 206/605 |
| 3,011,691 | 12/1961 | McGlynn et al. | 206/605 |
| 3,565,329 | 2/1971 | Wagner et al. | 206/618 |
| 3,599,859 | 8/1971 | Maierson | 206/616 X |
| 4,795,035 | 1/1989 | Kim | 206/616 |

FOREIGN PATENT DOCUMENTS

| | | | |
|---|---|---|---|
| 1194243 | 11/1959 | France | 206/618 |
| 117001 | 12/1926 | Switzerland | 206/618 |
| 400750 | 4/1966 | Switzerland | 206/618 |
| 563919 | 7/1975 | Switzerland | 206/618 |
| 16784 | 9/1893 | United Kingdom | 206/618 |

*Primary Examiner*—Byron P. Gehman

*Attorney, Agent, or Firm*—Anthony J. Casella; Gerald E. Hespos

[57] ABSTRACT

A tear band opening device disposed on an opening-closing flap of a container which comprises a non-tearable plastic or metal tear band positioned on the inside thereof along a perforated punch line and a non-tearable plastic guide strip. Thus, the tear band disposed between the guide strip and a glued portion disposed on the inside of the flap thereof is in substantially parallel relationship to the guide strip for use in easily and readily opening the container.

12 Claims, 4 Drawing Sheets

CONTAINER WITH AN OPENING DEVICE COMPRISING A GUIDE STRIP AND TEAR BAND

CROSS REFERENCE TO RELATED APPLICATION

This application is a continuation-in-part of Ser. No. 947,806 filed Dec. 30, 1986, and is related to application Ser. Nos. 901,741, 901,744, and 901,942 filed Aug. 29, 1986, Ser. No. 947, 966 filed Dec. 30, 1986, Ser. No. 042,787 filed Apr. 27, 1987, Ser. No. 077,443 filed Jul. 24, 1987, and Ser. Nos. 081,239 and 081,240 filed Aug. 4, 1987.

BACKGROUND OF THE INVENTION

The present invention relates to a tear band opening device. More particularly, the present invention relates to a container, for example, a package, an envelope, carton or corrugated box containing a non-tearable plastic or metal guide strip or ridge positioned on an inside surface of a sealing portion of the container. The plastic or metal guide strip is positioned between dotted punch lines and disposed between a small plastic or metal tear band attached to the outside surface of the sealing portion, on one side, and a glued portion disposed on the inside surface of the sealing portion thereof, on the other side, for use in easily and readily opening the container.

Many types of package opening devices have been developed in the packaging industry to facilitate the opening of packages. For example, packages such as sugar containers or the like have been designed with perforated punch lines disposed along the middle of the packages.

Also, envelopes have been designed to contain a thread positioned along the bottom thereof. However, these packages and envelopes suffer from a number of disadvantages, such as, they are difficult to open easily and, thus, an opening device, such as a paper opener, must be used for opening the packages or envelopes. Also, it has been found that the thread positioned along the bottom of an envelope produces a zigzag cut in the paper when the containers are opened. Furthermore, to tear packages provided with perforated punch lines, made of thin paper products is very difficult.

In the specification of my copending applications Ser. Nos. 901,741 and 901,744, entitled "A Tear Strip Opening Device" filed on Aug. 29, 1986, I have described and claimed a tear band opening device characterized by utilizing a pair of plastic tear bands attached to the outside surface of the container. However, it is to be noted that, if the tear band opening device is utilized on the sealing portion of the envelope or package, one of the pair of plastic tear bands should be attached to the glued portion thereof, which increases the manufacturing cost.

OBJECTS AND SUMMARY OF THE INVENTION

Accordingly, it is an object of the present invention to provide a tear band opening device for use in producing a straight opening in a package or envelope in an easy manner.

Another object of the present invention is to provide a package which utilizes a plastic or metal guide strip tightly attached to a sealing portion of an envelope or box for facilitating the easy opening thereof.

A further object of the present invention is to provide a package, envelope, carton or corrugated box containing a non-tearable plastic guide strip or ridge positioned on the outside thereof along one or more perforated punch lines and a non-tearable material, e.g., a plastic or metal tear band disposed on the inside of the package or envelope. Thus, the plastic or metal tear band is disposed between the adjacent guide strip and a glued portion disposed on the inside of the sealing portion thereof in a substantially parallel relationship to the plastic or metal guide strip for use in easily and readily opening the envelope, box or package along a tear line (or lines) which is straight.

The present invention relates to a tear band opening device disposed on a sealing portion of a container which comprises a non-tearable plastic guide strip or ridge positioned on the outside thereof along a perforated punch line and a non-tearable material, e.g., a small plastic tear band disposed out of the sealing portion thereof and on the opposite side from the guide strip. Thus, the tear band disposed between the plastic guide strip and a glued portion disposed on the inside of the sealing portion thereof is in a substantially parallel relationship to the plastic guide strip for use in easily and readily opening the container.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

Figure 1:
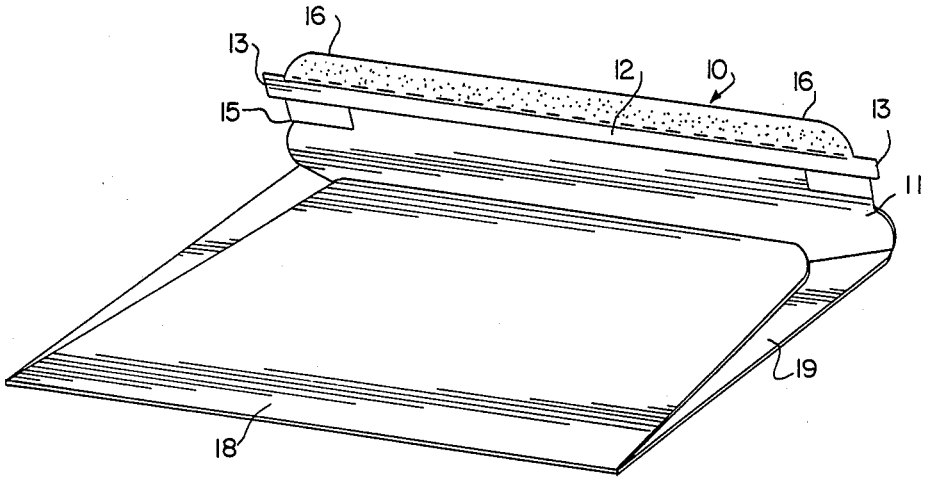
FIG. 1 is a perspective view of an unsealed envelope including the tear band opening device disposed on a sealing portion thereof, of the present invention.
Figure 2:
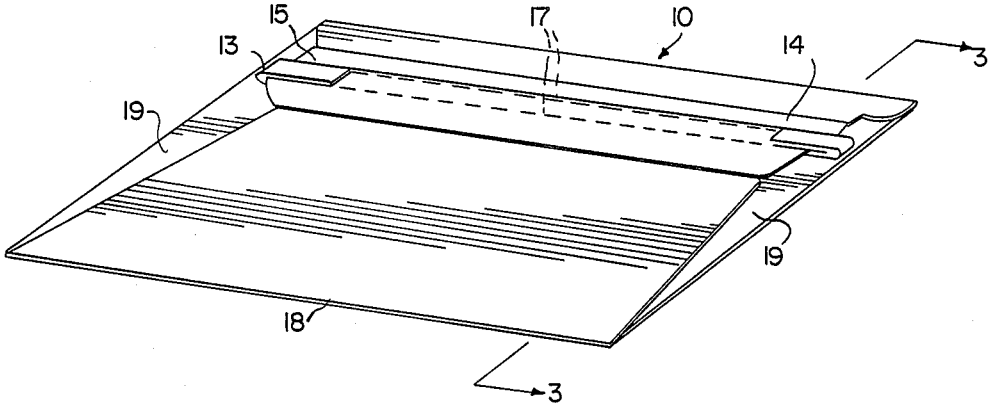
FIG. 2 is a perspective view of an envelope including the tear band opening device disposed on the sealing portion thereof, according to the present invention.

Referring now in detail to the drawings for the purpose of illustrating the present invention, the tear band opening device for opening a container 10 as shown in FIGS. 1 and 2 comprises a non-tearable plastic or metal tear band 12 sealably attached to the inside surface of a sealing portion 11 of the container 10 such as an envelope (FIGS. 1-5) or a corrugated box (FIGS. 6, 7, 9 and 10), or a carton (FIG. 8) disposed between perforated punch lines 17. A small plastic guide strip 14 is sealably attached to the outside surface of the sealing portion 11 of the container 10 and disposed on the opposite side from the tear band 12. The sealing portion 11 of the container 10 is provided with a glued portion 16 disposed on the inside surface thereof. The glued portion 16 and the plastic guide strip 14 are disposed substantially parallel to each other and on opposite sides from each other.

Figure 3:
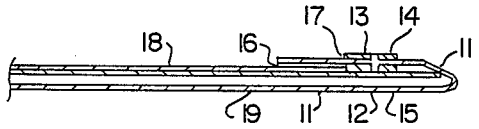
FIG. 3 is a cross-sectional view taken generally along the plane defined by reference line 3—3 of FIG. 2.

Both ends of the tear band 12 extend and fold around the surface of the sealing portion 11 of the container 10 for exposing the end of the tear band 12 which function as handles 13 for facilitating the opening of the container 10 (FIG. 2). Both ends of the tear band 12 fold around the surface of the sealing portion 11 of the container 10 for forming folded ends 13 for easily tearing the tear band 12 from the sealed container 10 (FIG. 1). The glued portion 16 is disposed on the opposite side as the guide strip or ridge 12. The perforated punch lines 17 are disposed only on the sealing portion 11 of the container 10 (FIG. 3). Furthermore, if desired, the punch line 17 located between the tear band 12 and the guide strip 14 may be omitted, since that edge will tear straight due to the guidance of the tear provided by the adjacent edge of the outer guide strip 14.

The tear band 12 can be made of any type of material which is sufficiently strong to cut paper products. Suitable tear band materials include flexible plastic materials, such as polyvinyl chloride or the like, and metal material, such as aluminum. Also, the guide strip 14 sealed to the outside surface of the sealing portion 11 of the container 10 in a conventional manner is made of various synthetic plastic materials to easily and readily permit tearing the tear band 12 from the sealed container 10 (FIG. 4).

Figure 5:
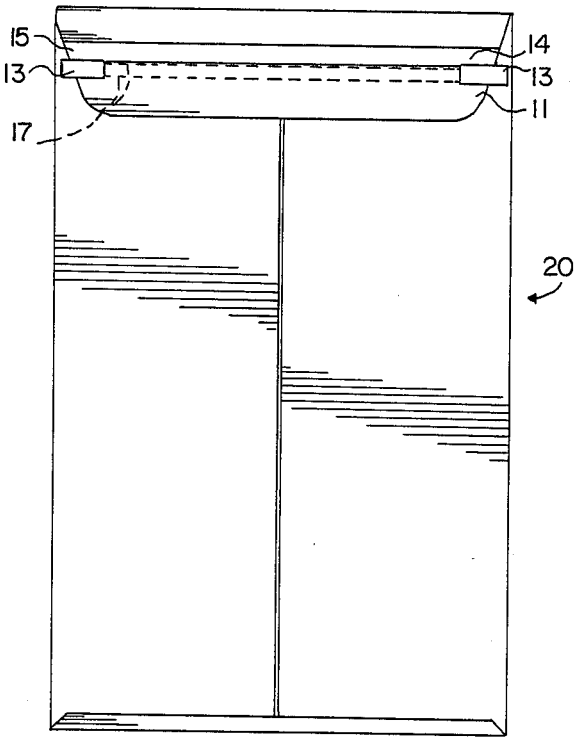
FIG. 5 is a front view of a large envelope containing the tear band opening device thereof in another embodiment of the present invention.

FIG. 5 illustrates another embodiment of the present invention. In this regard, also, the tear band device is located on the sealing portion 11 of the large envelope 20. The small non-tearable plastic guide strip 14 and tear band 12 are disposed on opposite sides from each other and provided with perforated punch lines 17 disposed therebetween for easily cutting the paper products. The handles 13 made by folding both ends of the tear band 12 can be readily grasped by the user.

In operation, for example, the paper to be formed into an envelope 10 is provided with the tear band 12 sealably attached to the inside surface of the sealing portion 11 thereof. After a letter or enclosures is inserted into the envelope 10, the envelope is sealed with the glued portion 16 of the sealing portion 11 to side portions 19 and a front portion 18 thereof (FIG. 2).

Figure 4:
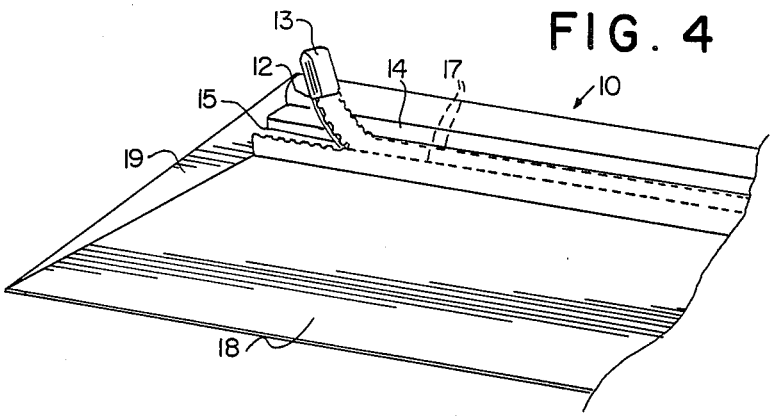
FIG. 4 is an enlarged perspective view showing an opening tab of the envelope including the tear band opening device of the present invention.

As shown in FIG. 4, the envelope can be readily opened by tearing off the handle 13 and tearing the envelope 10 along the perforated punch lines 17 with the tear band 12. At this time, the tear band 12 can readily be separated from the sealed envelope 10 since the tear band 12 is disposed between the plastic guide strip 14 and the pasted and sealed glue portion 16 on the outside surface and the inside surface of the sealing portion 11 of the small and large envelopes 10 and 20, respectively.

Although the tear band opening device is shown for opening a letter, it is apparent that it could be utilized for opening any type of container which can be readily cut by the tear band. Thus, a paper opening device, e.g., a letter opener is never necessary when using the present invention. It is also apparent that the exposed handle can be eliminated as long as there is an effective way of grasping the tear band, for example, by the use of a tab attached to one end of the tear band.

Figure 6:
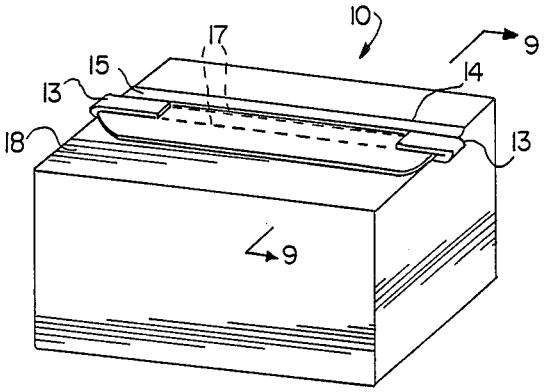
FIG. 6 is a perspective view of a sealed corrugated box including the tear band opening device disposed on a sealing portion thereof, of the present invention.
Figure 7:
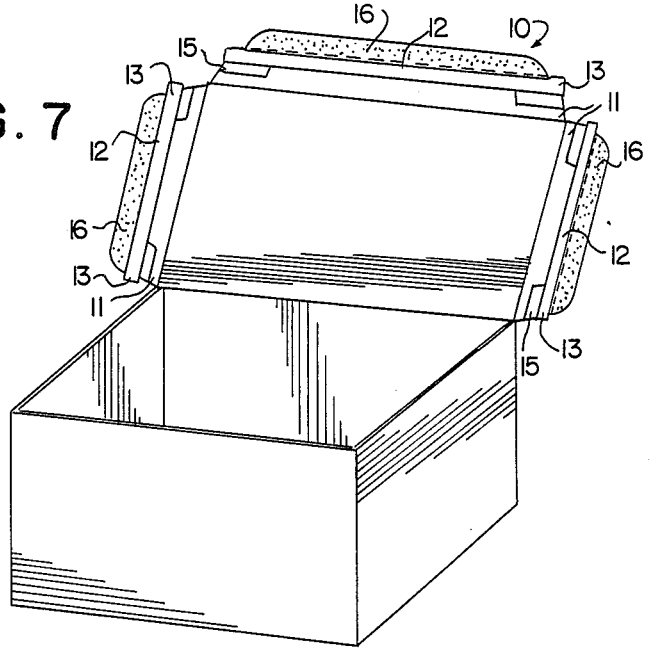
FIG. 7 is a perspective view of an unsealed corrugated box including the tear band opening device disposed on triple sealing portions thereof, of the present invention.
Figure 9:
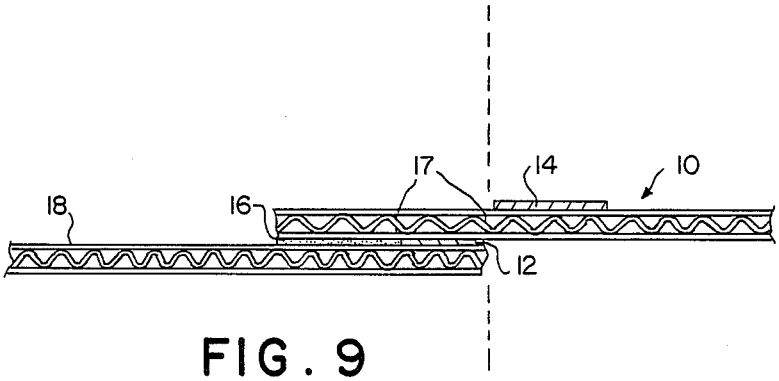
FIG. 9 is a cross sectional view through a portion of the corrugated box shown in FIG. 6 and taken generally along the plane defined by reference line 9—9 of FIG. 6 before the corrugated box is opened.

FIGS. 6 and 7 illustrate corrugated boxes with the opening device of the present invention used on the cover or top flaps. FIG. 9 shows a cross section taken through the top panel of the corrugated box shown in FIG. 6. These are corrugated boxes, but can also be of the cardboard type. The corrugated type is especially suitable to be used with larger boxes. As will be apparent from the drawings, the opening devices in each figure operate in the same manner as described in connection with FIGS. 1-5. In the event very stiff and hard to tear corrugated boxes are used, the tear band may be made of a material which will permit it to be tightly gripped so that it can be pulled through the material of the flap and provide the opening as desired, with straight and neat appearing edges. Thus, a metal tear band would be used here, e.g., aluminum, so that the corrugated box panel may be opened by using the tear band.

Figure 8:
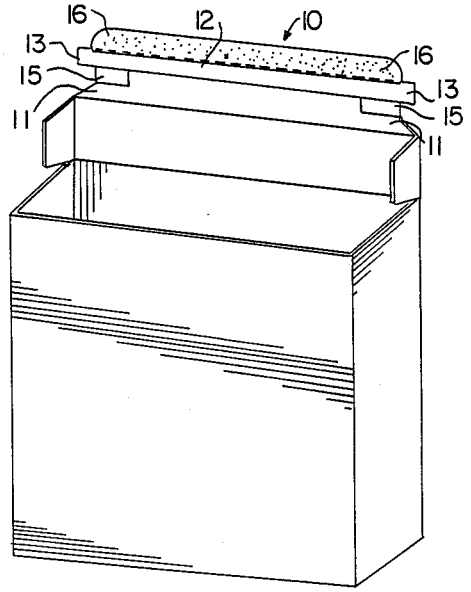
FIG. 8 is a perspective view of an unsealed carton including the tear band opening device disposed on a sealing portion thereof, of the present invention.

FIG. 8 illustrates the opening device used on cartons, and depending upon the thickness of the material of which it is made, a plastic or metal tear band will be used.

Figure 10:
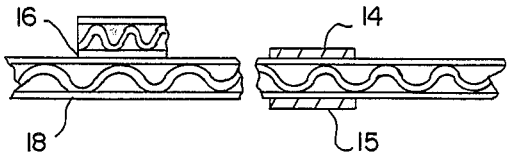
FIG. 10. is a cross sectional view similar to FIG. 9, but illustrating the arrangement after the box has been opened by tearing it open with the tear band.

FIGS. 9 and 10 show the corrugated box of FIG. 6 in its sealed condition before the present invention is used to open the box (FIG. 9) and after the present invention has been used to open the box and provide clean and straight tear lines so that the flaps and the sealing portion can be placed into their original position while still presenting a neat appearance (FIG. 10). Thus, the sealing portion 11 can be opened and closed to open and close access to the interior of the box. When finished obtaining access to the interior, a user simply presses the sealing portion or flap 11 down until it is in alignment with flap 18 to provide a neat appearance and a closed box as shown in FIG. 10.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

I claim:

1. A container having an opening-closing flap with inside and outside surfaces and provided with an opening device which comprises:

a strip of adhesive disposed along a straight line on the inside surface of said opening-closing flap for sealing the container, a non-tearable guide strip disposed in a straight line along the outside surface of said opening-closing flap, and a non-tearable, elongated straight tear band attached to the inside surface of said opening-closing flap, one elongated edge of said tear band being adjacent said adhesive strip, while the opposite elongated edge of said tear band is aligned with an edge of said guide strip whereby the tear band is disposed between said adhesive strip and said guide strip so that when said flap is sealed by said adhesive and said tear band is freed and pulled away from the container, the container is opened with a tear line which extends along the container flap in a straight line defined by said adhesive strip and said tear band.

2. The container as defined in claim 1, wherein the tear band has free ends which extend along the inside surface and fold around the outside edges of the container and onto the outside surface.

3. The container as defined in claim 1, wherein the tear band contains at least one free end which extends and folds from the inside surface to the outside surface of said flap.

4. The container as defined in claim 1, wherein a tab is attached to one end of the tear band for opening the envelope.

5. The container as defined in claim 1, wherein the container is a carton.

6. The container as defined in claim 1, wherein the container is an envelope.

7. The container as defined in claim 1, wherein the tear band or guide strip is made of plastic.

8. The container as defined in claim 7, wherein the plastic includes polyvinyl chloride.

9. The container as defined in claim 1, wherein the container is a corrugated box.

10. The container as defined in claim 1, wherein the tear band or guide strip is made of metal.

11. The container as defined in claim 10, wherein the metal includes aluminum.

12. The container as defined in claim 1, wherein there are lines of perforation through the flap along each elongated edge of said tear band so that when said tear band is pulled to open the flap of the container, the tear lines are straight.

* * * * *